US005318497A

United States Patent [19]

Aarnink et al.

[11] Patent Number: 5,318,497

[45] Date of Patent: Jun. 7, 1994

[54] COMBING ROLL ASSEMBLY

[76] Inventors: Bernhard A. Aarnink, 4506 Columbine Ct.; Joseph H. Hilton, 6836 Pin Oak Ct., both of Charlotte, N.C. 28226

[21] Appl. No.: 927,455

[22] Filed: Aug. 10, 1992

[51] Int. Cl.[5] ..... D01G 19/10; D01H 4/32

[52] U.S. Cl. ..... 492/30; 492/47; 19/97; 19/112; 57/408

[58] Field of Search ..... 29/120, 121.1, 123, 29/124, 125, 130; 57/408; 19/97, 112, 114; 15/230.14; 492/30, 47

[56] References Cited

U.S. PATENT DOCUMENTS 4,196,496 4/1980 Stauffer et al. ..... 29/121.1
4,296,527 10/1981 Eadie ..... 19/112
4,939,897 7/1990 Schmolke ..... 57/408

*Primary Examiner*—Timothy V. Eley
*Assistant Examiner*—Khan V. Nguyen
*Attorney, Agent, or Firm*—Judith E. Garmon

[57] ABSTRACT

An improved combing or opening roll assembly for open-end spinning machines includes means for cleaning the inner cavities by direct axial injection of compressed air into the cavity, and an outer surface configuration designed to inhibit or prevent accumulation of microdust and fibers thereon. One outer surface of the roller unit includes a color-coded speed indicating means which enables an operator immediately to visualize the relative speed of rotation, as a safety factor decreasing the likelihood that an operator would inadvertently touch the combing ring during rotation.

8 Claims, 3 Drawing Sheets

COMBING ROLL ASSEMBLY

BACKGROUND & SUMMARY OF THE PRESENT INVENTION

Several types of opening cylinders and rollers exist for use on open end spinning machines, and are used for combing and aligning the fibrous materials being processed. Such units are described in various U.S. Patents including those numbered U.S. Pat. Nos. 4,067,625; 4,939,897; 4,805,395; 3,750,380; and 5,088,266 (as examples only). Most of the known devices include a shaft rotatably mounted in a bearing housing, and an opening roller mounted on the end of the shaft which projects from the bearing box. These fittings are subjected to incredibly high stress and must be replaced periodically. Prior art devices and patents teach the manufacturing of a base member and ring which can be removed and exchanged when worn. Still others teach a structure and methodology for protecting the bearings of the opening roller shaft from entrance of contaminants such as fiber remnants, fiber fly, and microdust. The penetration of fibers and microdust particles into the cylinder roll and casing, if allowed to accumulate, can cause speed loss and even bearing seizure or jamming, and such contaminants substantially shorten the life of the components.

Most approaches to cleaning the bearing box and shaft of the opening roller involve the removal of at least the cylinder ring in order to remove the fibers and dust particles collected in the spacial tolerances around the bearing box and shaft. Such a procedure of course requires a considerable amount of machine down time and labor. One later approach taught in U.S. Pat. No. 4,939,897 involves the use of an opening cylinder having at least two air passageways or ducts through which compressed air is injected to bow out contaminants and clean the inner cylinder. The structure described therein creates an air flow pattern whereby compressed air injected into one of the ducts must move through a recess in the inner body of the cylinder, into a radial connecting duct, and then into the hollow cavity surrounding the bearing housing. Contaminant material, then exits an opposite radial connecting duct and out a second cleaning duct. Therefore the airflow pattern is not along a direct or clean flow path, causing some loss of air pressure and resulting cleaning capacity.

It was to the provision of an opening roller or cylinder having an improved structure for maintenance purposes, and to the provision of means for improving the safety of maintenance procedures, that the present inventor turned. Further objectives were improved operation due to decreases in maintenance time, and increased cost effectiveness due to extended life of component parts.

The present invention is directed to an improved opening roller or cylinder assembly: having a plurality of ducts for injection of air into the roller along a direct path parallel to the axis of the rotating shaft; having a surface-mounted means for propelling dust and fiber contaminants away from the roller assembly; and having visual means for demonstrating rotation of the assembly so that personnel do not touch or otherwise engage the roller during machine operation.

The present device is adaptable to all types of existing machinery and to various ring styles. The roller head is designed to accommodate combing rings wound with opening wire, or rings with needles mounted in any surface arrangement. Generally, prior art devices require that the opening roller be removed from the machine, and special tools be used, to remove the wire or pin rings. However, with the present invention, the rings can be replaced at the machine without special tooling or machine downtime.

The structure that enables the meeting of these objectives includes: a combing roll head having contoured outer surfaces which eliminate accumulation of dust and fibers thereon; separable components whereby forward and rear collar members are threadedly connected to each other to support a combing ring therebetween; the collars having threads formed in counterclockwise relationship such that jamming of the components is eliminated; wedge-shaped projections on the outer surface of the rear collar to create turbulence and propel dust away from the roller assembly; at least two air ducts, one on either side of the bore through which the shaft is mounted, aligned parallel to the shaft, and extending directly into the hollow cavity which surrounds the bearing box; and at least one countersunk, color-coded bore on the outer collar for indicating when the roller head is in rotation or is at a standstill.

By utilizing such a structure it has been possible to substantially reduce the machine downtime, increase the life of the roller head and components, reduce maintenance costs, and reduce risk of injury to personnel. The structure, features and advantages of the present invention will become apparent from the following detailed description studied in conjunction with the accompanying drawings.

DETAILED DESCRIPTION OF A PREFERRED EMBODIMENT

Figure 1:
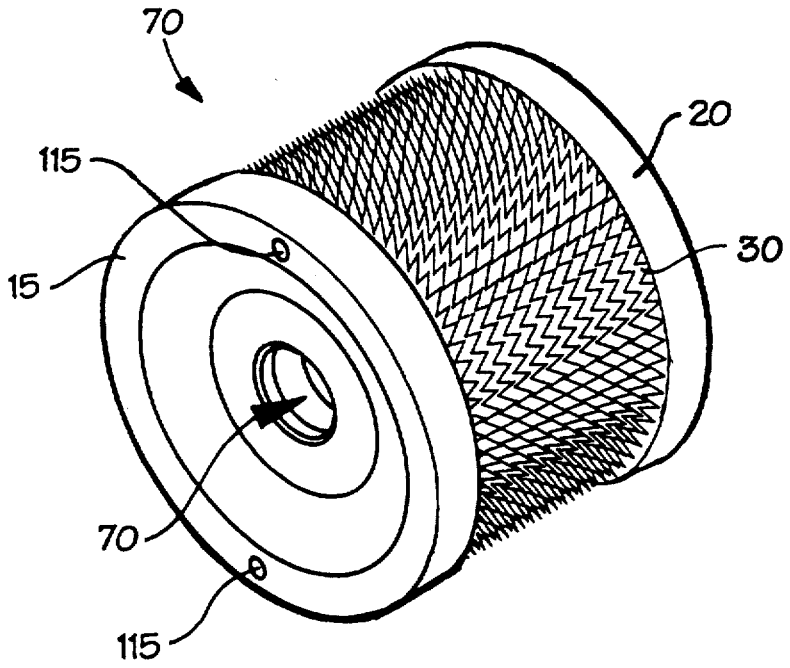
FIG. 1 is a perspective view of a preferred embodiment of the invention showing a first or forwardly facing surface of the combing roll head.

Looking first at FIG. 1 an assembled opening or combing roll head 10 is shown, including a forwardly or outwardly facing (relative to the shaft mounting inwardly toward the machine) first collar 15, a rearwardly or inwardly facing second collar 20, and a removable combing ring 25 secured therebetween. The ring 25 of the present device is wound with opening wire 30, but the ring could utilize a needle surface or a diamond surface by choice depending upon a particular application. The ring 25 is secured between the two collars 15 and 20 but is easily removed by separation of the two collars.

Figure 3:
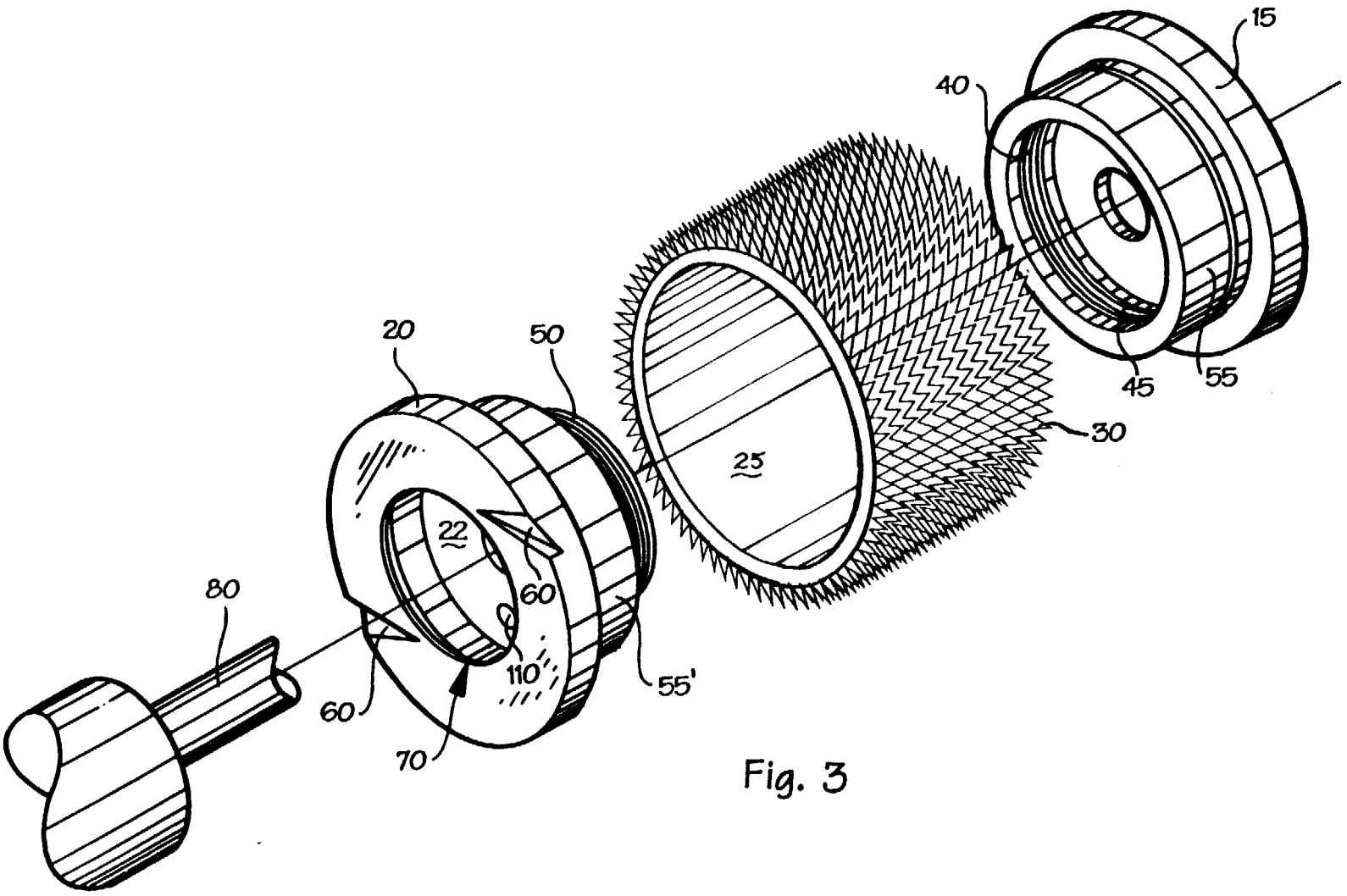
FIG. 3 is an exploded perspective of the device shown in FIGS. 1 and 2, including the rotatable shaft.

As best shown in FIG. 3, the combing head 10 is disassembled by means of the threaded connection of the collars 15 and 20. First collar 15 includes a female connection 40 on the inner surface thereof, having threads 45 for receiving the outer threaded surface of the male connector 50 that extends from the inner surface of second collar 20. The combing ring 25 is supported on cylindrical flanges 55 and 55' of the respective first and second collars and secured against rotation. The threaded members 40 and 50 are designed such that the threading is counterclockwise to the direction of the rotation of the head. Thus the threads are less likely to jam or freeze after long periods of rotational force, and the collars will separate easily.

The first or outer collar 15 has a smoothly concave outer surface (FIGS. 1 and 3), free of sharp angles or creases, designed to eliminate or substantially lessen the accumulation of dust and fibers on the surface thereof. Elimination of microdust and particles on this surface reduces the likelihood of their being pulled into the shaft area by rotational forces.

The oppositely mounted second collar 20 includes at least two wedge-shaped projections 60 on the surface thereof for creating air turbulence at the rear of the assembly 10. By so doing, the turbulence repels or diverts microdust and particles which approach the back wall of the assembly, forcing the dust away in the opposite direction. Creation of such turbulence means that very little dust reaches the assembly and gathers therein. While wedge-shaped projections are preferred, it is known that a spiral surface on the rear collar 20 could be utilized also.

Some microdust and fibers will accumulate and be drawn into the assembly 10 through the junctures and tolerances between the ring 25 and collars 15 and 20, but more particularly through the assembly bore 70 that receives the rotatable shaft 80 on which the assembly 10 is mounted. Looking at FIGS. 3 and 4 it is shown that shaft 80 is supported in a bearing box 85 which, when the unit is assembled, is surrounded by a cavity 90 formed by the roller assembly extending over the end of the bearing box 85. It is in this cavity that the greatest amount of dust and fibrous lint accumulates, with the greatest potential for damage. As previously described this cavity 90, in most prior art, is cleaned by disassembly of the roller unit 10, or by indirect injection of air as described in U.S. Pat. No. 4,939,897.

Figure 2:
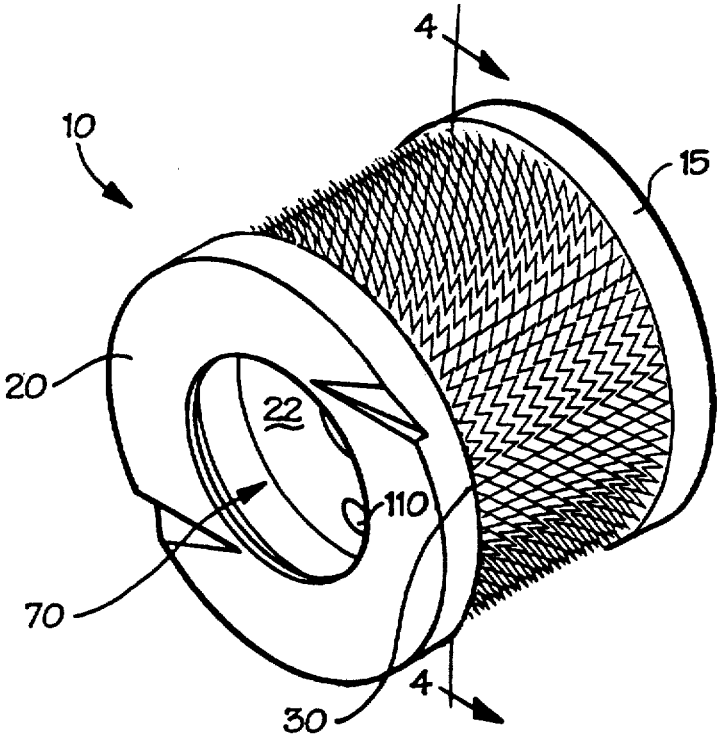
FIG. 2 is a perspective view of the embodiment of FIG. 1, shown from the opposite side and revealing a second or rearwardly facing surface.
Figure 4:
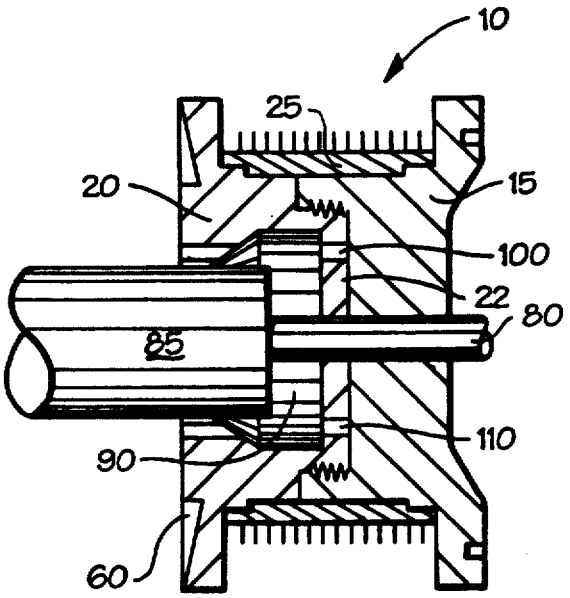
FIG. 4 is a partial cross-sectional view taken along lines 4—4 of FIG. 2.
Figure 5:
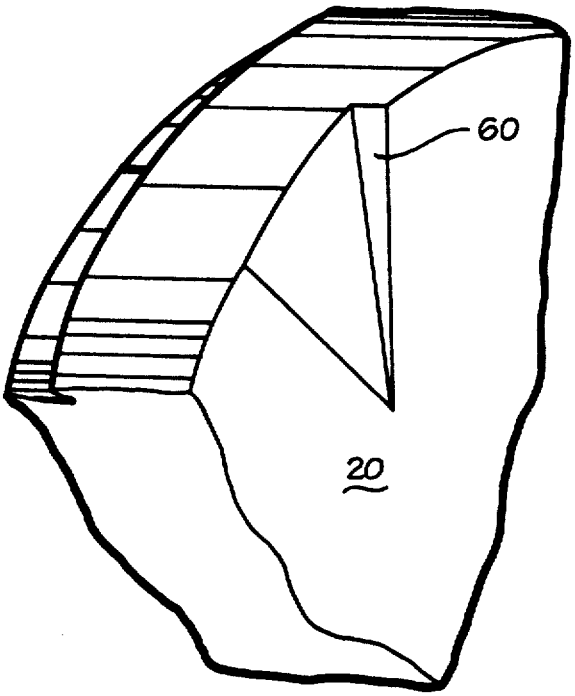
FIG. 5 is an enlarged perspective view, with parts broken away, of the rearwardly facing surface shown in FIG. 2.

In the present invention the improved structure enables the injection of compressed air directly into the cavity 90 and the bearing housing therein. As best shown in FIGS. 2, 3 and 4, a pair of axial bores 100, 110, extending along an axis parallel to shaft 80, are tapped through the recessed side wall 22 of collar 20 into cavity 90. By inserting a nozzle into either one of the bores 100 or 110, compressed air is injected in a straight flow path directly into cavity 90, with microdust and lint being blown out of the other one of the bores. There is no obstacle to the flow of air in and out; thus no loss of air pressure needed to remove the debris. There is no necessity for breaking down the roller unit 10 and routine cleaning can be carried out at the machine with little downtime.

The inner diameter of the bores 100, 110 is not a critical factor beyond the necessity of it being sufficiently large to permit injection of adequate air flow into cavity 90. The positioning of the bores is optimal when on opposite sides (180 degrees) of the radius of the collar. Less separation can result in reduced air pressure to blow out debris.

When maintenance procedures or other inspection is necessary, safety features relative to awareness of roller movement and speed of revolution are provided on the first or outer collar 15. At least one, and preferably two oppositely positioned, countersunk apertures 115 (see FIG. 1) are provided on the outer rim of collar 15. These apertures 115 are color coded by coating with paint or other material such that visibility is heightened. An operator can use this speed indicator means to tell immediately if the roller unit 10 is rotating simply by looking at the rim of the collar and "reading" the movement of the color-coded apertures.

Additionally, the apertures 115 are sized and positioned to receive a conventional hand tool for engaging and turning the collar to disassemble the unit. Having the capability of using apertures 115 as a means for engaging the collar, combined with the afordescribed counterclockwise threading of the male/female collar connectors 40 and 50, results in a disassembly means that functions quickly and easily, on-site, in all but the worst cases of neglect wherein the roller unit 10 is jammed or frozen by dust and debris.

While a preferred embodiment of the device has been shown and described, it is understood that other embodiments and modifications are anticipated and encompassed by the scope of the claims below.

What is claimed is:

1. A combing roll head and roller assembly for open-end spinning machines; said assembly including:

A) a bearing box and a shaft rotably mounted therein;

B) said shaft having a free end projecting from said bearing box, and a combing roll head fixedly mounted thereon;

C) said combing roll head including:

i) a first collar member and an opposingly connected second collar member; each of said collars having an outer cylindrical flange and a recessed sidewall;

ii) a removable combing ring fixedly mounted between said first and second collar members;

iii) a cylindrical bore extending through said combing roll head for receiving said rotating shaft and bearing housing therethrough;

iv) a cavity formed within said combing roll head in the area where said combing roll head is mounted on said bearing box;

v) a pair of opposingly positioned injector bores tapped through said sidewall of said second collar for injecting compressed air therethrough; each of said injector bores extending in a straight path from said collar sidewall directly into said cavity, along a line parallel to the axis of said rotatable shaft;

whereby air is injected through a first one of said injector bores, directly into said cavity, and accumulated dust and debris is blown from said cavity out of the other of said injector bores.

2. The assembly according to claim 1 and further including said combing roll head having an outer surface configuration with means for inhibiting the collection of dust and debris thereon, said outer surface configuration comprising said sidewall of said first collar member having a smoothly concave outer surface free of indentations and crevices; whereby normal rotation of the combing roll head will prevent accumulation of dust on said concave surface.

3. The assembly according to claim 1 and further including said combing roll head having an outer surface configuration with means for inhibiting the collection of dust, and debris thereon, said surface configuration comprising said second collar member having an outwardly facing, circumferential flange portion, and at least one projecting member extending outwardly from at least one segment of said flange, to create a pattern of air turbulence therearound when said combing head is rotating; whereby said air turbulence propels dust and debris away from said combing roll head.

4. The assembly according to claim 2 wherein said outer surface configuration further includes said second collar member having an outwardly facing, circumferential flange portion, and at least one projecting member extending outwardly from at least one segment of said flange, to create a pattern of air turbulence therearound when said combing head is rotating; whereby said outer surface configuration repels dust and debris therefrom during operation.

5. The assembly according to claim 1 and further including safety means for indicating the rotational movement of said combing roll head, to prevent an operator touching the combing roll head during operation.

6. The assembly according to claim 5 wherein said safety means comprises at least one color-coded indicator on the peripheral outwardly facing surface of said first collar member.

7. The assembly according to claim 6 wherein said color-coded indicator is comprised of a pair of countersunk apertures in the face of said first collar member, said apertures being spaced a predetermined distance apart along the radius of said collar, for receiving a tool member therein to loosen the components of said roller head.

8. The assembly according to claim 1 and further including threaded means for connecting said first and second collar means having threads tapped in a direction counterclockwise to the rotational direction of said shaft; for facilitating removal of said head from said shaft.

* * * * *